US006220133B1

(12) United States Patent
Gosselin

(10) Patent No.: US 6,220,133 B1
(45) Date of Patent: Apr. 24, 2001

(54) GRADUATED FOOD-CUTTING KNIFE AND METHOD OF USE THEREOF

(76) Inventor: Denis Gosselin, 39, de Tilly, Boucherville (Quebec) (CA), J4B 4N9

( * ) Notice: Subject to any disclaimer, the term of this patent is extended or adjusted under 35 U.S.C. 154(b) by 0 days.

(21) Appl. No.: 09/365,232

(22) Filed: Jul. 30, 1999

Related U.S. Application Data

(60) Provisional application No. 60/097,532, filed on Aug. 21, 1998.

(51) Int. Cl.[7] ..... B26D 1/00

(52) U.S. Cl. ..... 83/13; 7/113; 7/163; 30/123; 30/286

(58) Field of Search ..... 83/13; 30/123, 30/286, 233; 7/163, 110, 113

(56) References Cited

U.S. PATENT DOCUMENTS

| | | | | |
|---|---|---|---|---|
| 3,981,078 | * | 9/1976 | Alberti | 30/293 |
| 4,513,501 | | 4/1985 | Lee . | |
| 4,782,730 | * | 11/1988 | Picone et al. | 30/300 |
| 4,993,093 | | 2/1991 | Goldwitz . | |
| 5,107,560 | | 4/1992 | Hulsey . | |
| 5,497,553 | * | 3/1996 | Chong | 30/162 |

FOREIGN PATENT DOCUMENTS

| | | |
|---|---|---|
| 3 44986 | 5/1933 | (CA) . |
| 1037701 | 9/1978 | (CA) . |

* cited by examiner

*Primary Examiner*—M. Rachuba
*Assistant Examiner*—Sean Pryor

(57) ABSTRACT

A graduated blade knife, and a method of use thereof for cutting a selected quantity of solid soft-bodied foodstuff, the knife of the type comprising a handle, a blade integrally attached to and aligned with said handle, the blade defining an outer free tip, and graduated marks along said blade, said method comprising the steps of: a) flatly applying the knife blade against a flat surface of the soft foodstuff; b) sliding the knife along the soft-bodies foodstuff so as to align the blade graduated marks on the soft foodstuff according to the selected quantity of foodstuff to be cut; c) pivoting the knife around the blade tip so that the blade becomes transversely positioned relative to the soft foodstuff; d) transversely driving the knife blade into the soft foodstuff until the blade extends completely through the soft foodstuff; e) pivoting the knife around the knife blade tip so as to cut the soft foodstuff along a cutting line; and f) cutting the selected quantity out of the soft foodstuff according to the cutting line made in step (e).

2 Claims, 5 Drawing Sheets

GRADUATED FOOD-CUTTING KNIFE AND METHOD OF USE THEREOF

This application claims benefit of Provisional 06/097,532, filed Aug. 21, 1998.

FIELD OF THE INVENTION

The present invention relates to a food-cutting knife, and more particularly to a graduated food-cutting knife and to the method of use thereof.

BACKGROUND OF THE INVENTION

When wanting to obtain a precise quantity of soft but solid food products such as butter, it is known to measure the butter in a graduated measure cup. To measure the butter is a rather long and messy operation. It is possible to weigh the butter, but then one must own kitchen scales, which is not a common occurence in domestic kitchens. To melt the butter is a rather long operation, considering that the only purpose thereof is to obtain the desired quantity of butter.

Canadian patent No 344,986 dated May 1933 with inventor William Duncan, discloses both a graduated scale stick and a separate knife, for cutting measured portion of butter. The graduated scale stick is applied along one side of the butter block with its graduated scale portion extending away from the butter block, so that this graduated scale be exposed for visual inspection by the user. The knife is used orthogonally of the graduate scale stick, so that the knife blade register with and remain within the plane extending through a selected graduated scale indicia corresponding to the butter body portion to be sliced. Obviously, this system is relatively complex, in that it requires two separate elements: the knife, and the stick, which must both be positioned at exactly right angle to one another and maintained motionless relative to one another.

U.S. Pat. No. 5,107,560 issued Apr. 28, 1992 to Michael Hulsey, discloses a conventional "scout" knife having an elongated handle and a blade pivotally elongated feeler gauge blade with a tapered gauging section on the feeler gauge blade having measuring indicia thereon. The feeler gauge blade has a near end and a projecting end with its near end being pivoted on a pivot pin with the cutting blade. One of the bearing plates is between the near end and the side piece while another bearing plate is between the near end of the feeler gauge blade and the near end of the cutting blade. The near end of the feeler gauge blade has a keeper receiving cutout, to maintain the blade in its open position, and abutment, to arrest the position of the blade in its closed position. Obviously, there is no means provided to prevent movement of the blade from its open to its closed position, since it is destined to retract into the handle. This is not as efficient as a handle fixedly secured in coaxial arrangement with its handle.

OBJECTS OF THE INVENTION

It is the gist of the present invention to provide a cutting tool, and a method of use thereof, for allowing rather precise quantities of soft or hard, solid foodstuff to be cut single-handedly in a simple manner.

SUMMARY OF THE INVENTION

In accordance with the teachings of the invention, there is disclosed a knife for cutting a selected quantity of solid soft-bodied foodstuff, said knife of the type comprising a handle, a blade integrally attached to and aligned with said handle, the blade defining an outer free tip, and graduated marks along said blade, and a method of use thereof, said method comprising the steps of: a) flatly applying the knife blade against a flat surface of the soft foodstuff; b) sliding the knife along the soft-bodies foodstuff so as to align the blade graduated marks on the soft foodstuff according to the selected quantity of foodstuff to be cut; c) pivoting the knife around the blade tip so that the blade becomes transversely positioned relative to the soft foodstuff; d) transversely driving the knife blade into the soft foodstuff until the blade extends completely through the soft foodstuff; e) pivoting the knife around the knife blade tip so as to cut the soft foodstuff along a cutting line; and f) cutting the selected quantity out of the soft foodstuff according to the cutting line made in step (e).

DETAILED DESCRIPTION OF THE EMBODIMENTS

Figure 1:
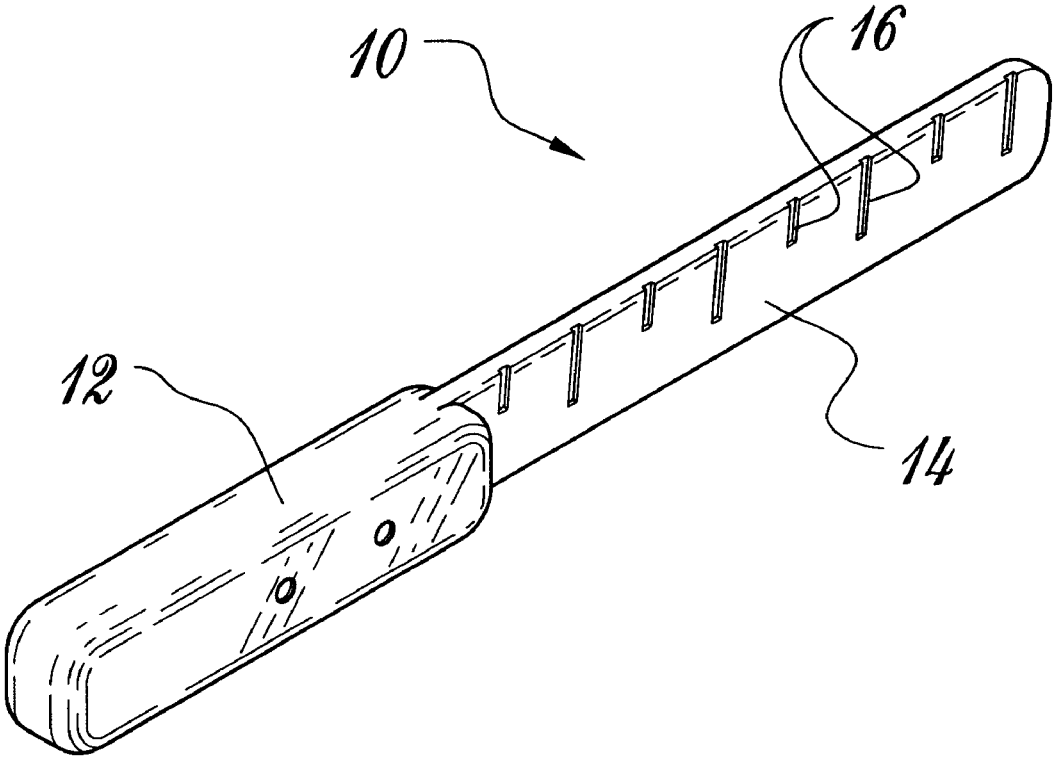
FIG. 1 is a perspective view of a cutting knife according to the invention.

FIG. 1 shows a knife 10 according to the invention. Knife 10 comprises a handle 12 integrally linked to a blade 14, which is aligned therewith in a conventional manner. Blade 14 comprises graduated marks 16 at regular intervals therealong. Marks 16 can be of any suitable unit, e.g. distance units (e.g. centimeters) or volume units (e.g. milliliters or ounces) according to predetermined references, e.g. corresponding to uniform butter block dimensions so as to yield the volume of butter which will be obtained by widthwisely cutting the butter block. Indeed, butter blocks are often sold for domestic use in one pound blocks of uniform rectangular shape, and therefore a distance graduation on the blade 14 can yield rather precise volume quantities of butter, by using the knife 10 according to the method described hereinafter.

Figure 2A:
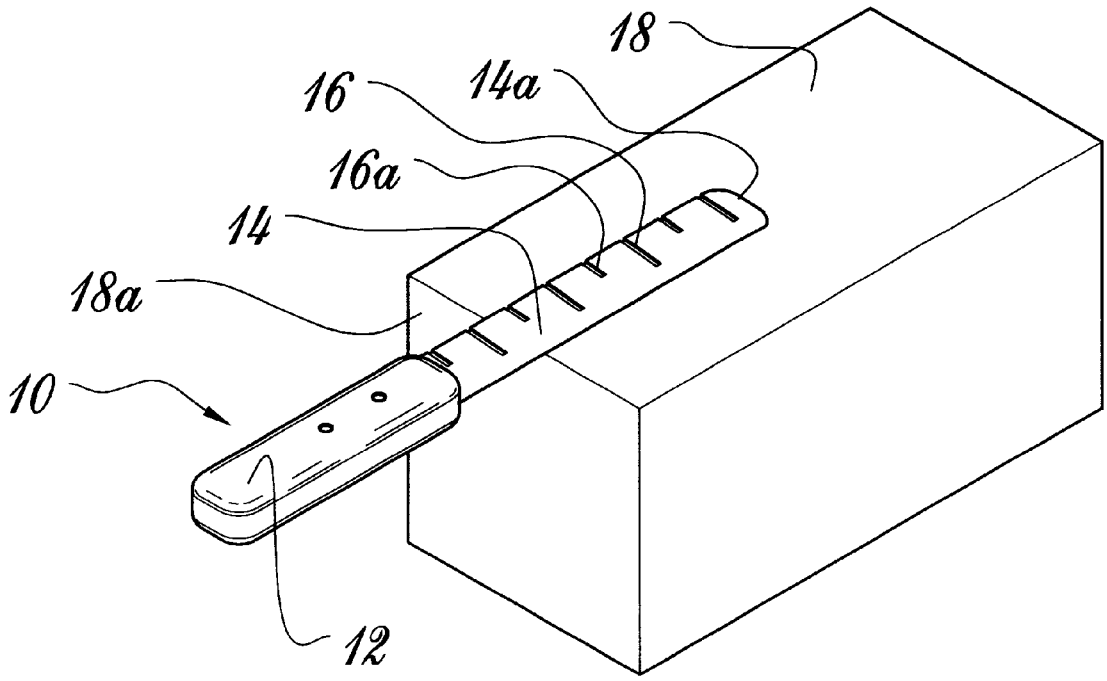
FIGS. 2*a*–2*d* are perspective views, at a slightly smaller scale, sequentially suggesting the use of the cutting knife according to the invention for cutting a rather precise quantity of butter out of a block of butter.

FIG. 2*a* shows that the knife 10 is first positioned with its blade 14 lying flatly on the flat top surface of the rectangular butter block 18 and in a subtantially longitudinally aligned fashion relative thereto. The graduated marks 16 are then used to select the quantity of butter that will be used, by aligning the desired mark 16*a* with the end edge portion 18*a* of the butter block 18.

Figure 2B:
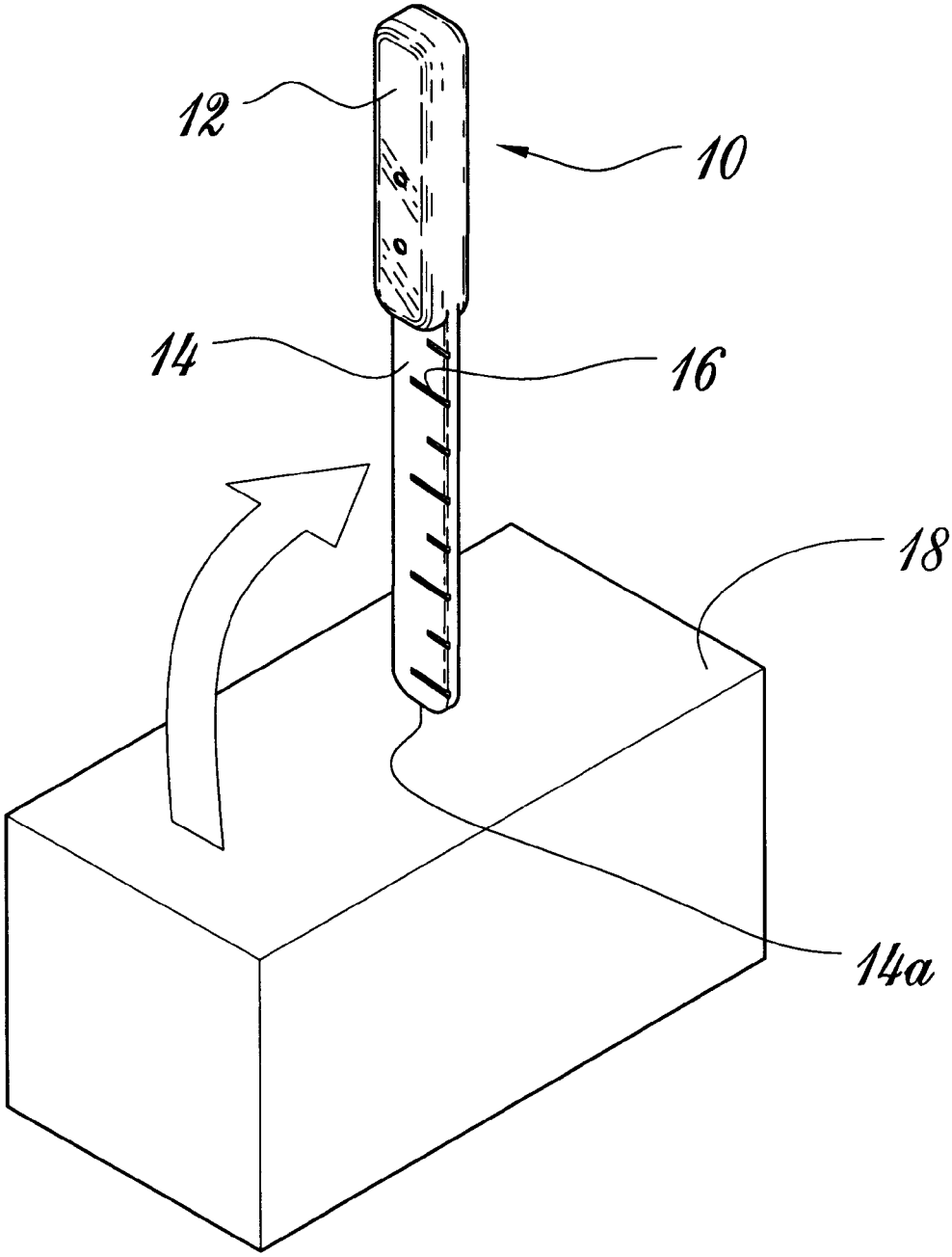

Once this is accomplished, the knife is pivoted around its blade tip 14*a* as shown in FIG. 2*b*, with the knife tip slightly digging into the butter block so as to provide a rather stable anchoring means to the pivotal movement of the knife 10.

Figure 2C:
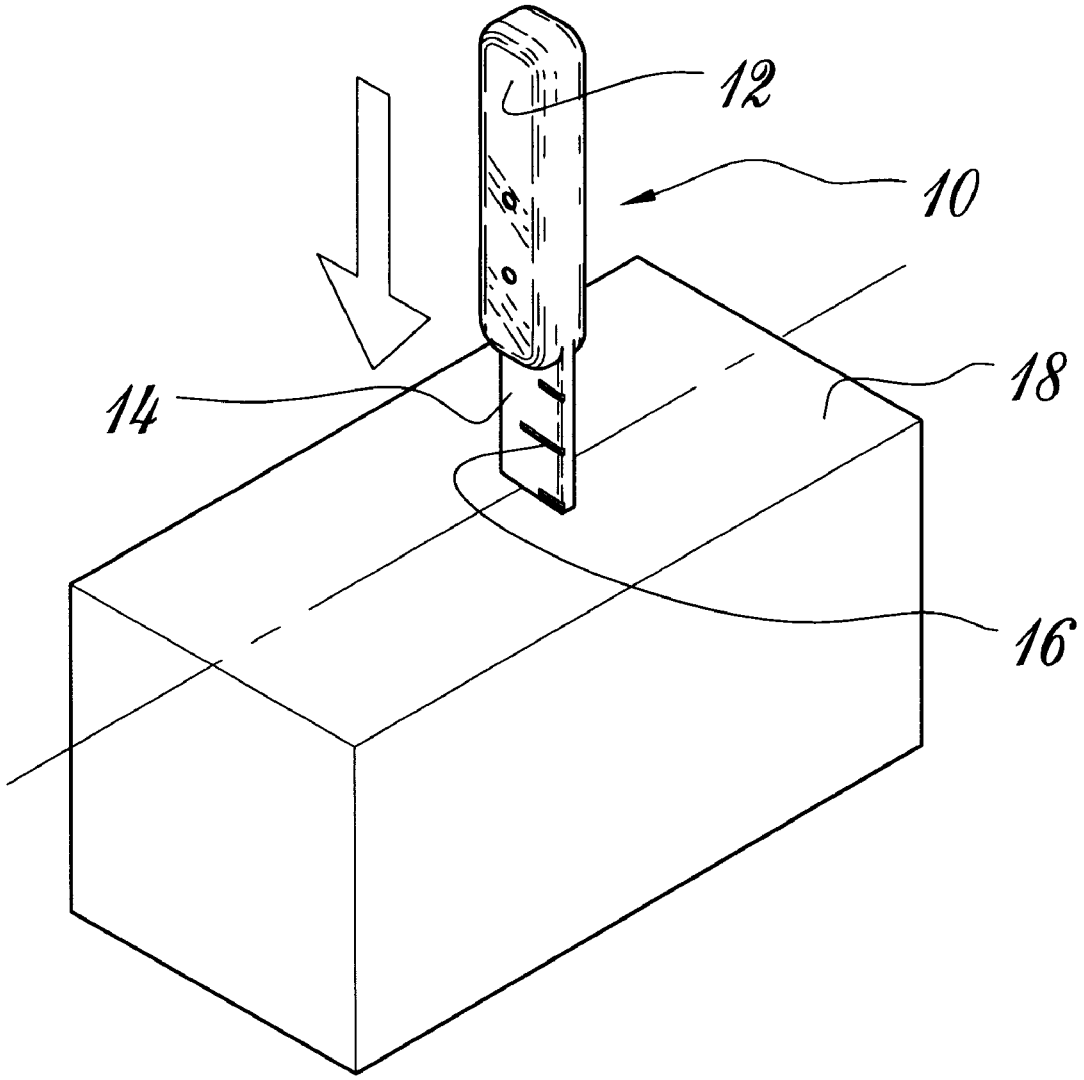

Once the knife 10 has reached a substantially vertical position, its blade 14 is vertically downwardly driven into the butter block 18 as shown in FIG. 2*c*.

Figure 2D:
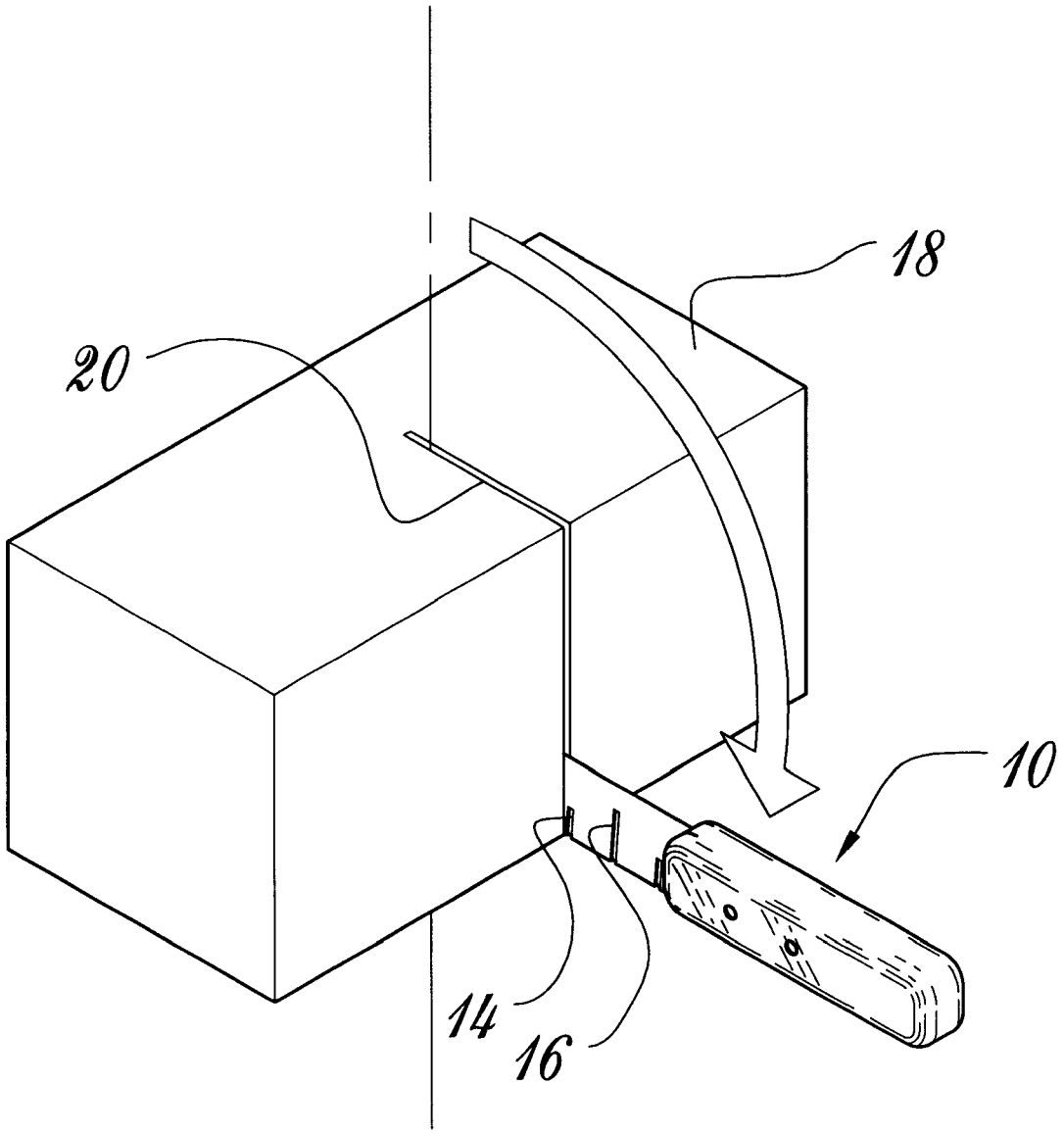

Afterwards, knife 10 can be laterally pivoted around its tip so as to cut the butter block 18 along a cutting line 20, as shown in FIG. 2*d*. To finish the cutting operation, the knife 10 can then be used to cut the remaining portion of the block 18 by aligning its blade 14 with the cutting line 20 which has been formed in block 18. Preferably, the knife blade will be applied against the side edge portion of the block of butter, instead of the center, to cut the entire butter block in a single pivoting movement.

Thus, a selected quantity of butter can be obtained due to the uniform quantity provided in the butter blocks and due to the graduation and method of use of the knife 10.

Although the present method has been described for use on a butter block, it is understood that any suitable soft-bodied foodstuff could be sliced with this graduated scale bladed knife, which does not exclude soft-bodies non-edible goods, and even solid good could also be cut in this manner.

An alternate embodiment would include a self-adhesive label with volume indicia thereon, to be applied against an unmarked knife blade.

I claim:

1. A method of use of a knife for cutting a selected quantity of solid soft-bodied foodstuff, said knife of the type comprising a handle, a blade integrally attached to and aligned with said handle, the blade defining an outer free tip, and graduated marks along said blade, said method comprising the steps of:

a) flatly applying the knife blade against a flat surface of the soft foodstuff;

b) sliding the knife along the soft-bodies foodstuff so as to align the blade graduated marks on the soft foodstuff according to the selected quantity of foodstuff to be cut;

c) pivoting the knife around the blade tip so that the blade becomes transversely positioned relative to the soft foodstuff at a cutting line;

d) pivoting the knife around thc knife blade tip so as to cut the soft foodstuff along said cutting line; and e) cutting the selected quantity out of the soft foodstuff according to the cutting line made in step (d).

2. A method of use of a knife for cutting a selected quantity of solid soft-bodied foodstuff, said knife of the type comprising a handle, a blade integrally attached to and aligned with said handle, the blade defining an outer free tip, and graduated marks along said blade, said method comprising the steps of:

a) flatly applying the knife blade againt a flat surface of the soft foodstuff;

b) sliding the knife along the soft-bodies foodstuff so as to align the blade graduated marks on the soft foodstuff according to the selected quantity of foodstuff to be cut;

c) pivoting the knife around the blade tip so that the blade becomes transversely positioned relative to the soft foodstuff;

d) transversely driving the knife blade into the soft foodstuff until the blade extends completely through the soft foodstuff;

e) pivoting the knife around the knife blade tip so as to cut the soft foodstuff along a cutting line; and f) cutting the selected quantity out of the soft foodstuff according to the cutting line made in step (e).

* * * * *